United States Patent [19]

Breslow et al.

[11] 4,045,024

[45] Aug. 30, 1977

[54] BOWLING ALLEY GAME

[75] Inventors: Jeffrey D. Breslow, Highland Park; Eugene Jaworski, Park Ridge; Tom Kenzo Sakoda, Chicago, all of Ill.

[73] Assignee: Marvin Glass & Associates, Chicago, Ill.

[21] Appl. No.: 698,177

[22] Filed: June 21, 1976

[51] Int. Cl.[2] ..... A63D 5/08

[52] U.S. Cl. ..... 273/43 A

[58] Field of Search ..... 273/43 R, 43 A, 42 A

[56] References Cited

U.S. PATENT DOCUMENTS

| | | | |
|---|---|---|---|
| 2,316,183 | 4/1943 | Patterson | 273/43 R |
| 2,469,886 | 5/1949 | Murphy | 273/43 R |
| 3,072,404 | 1/1963 | Jennings | 273/42 R |
| 3,132,863 | 5/1964 | Congelli | 273/43 A |

FOREIGN PATENT DOCUMENTS

| | | | |
|---|---|---|---|
| 2,202,843 | 7/1973 | Germany | 273/42 A |

*Primary Examiner*—Anton O. Oechsle

*Attorney, Agent, or Firm*—Mason, Kolehmainen, Rathburn & Wyss

[57] ABSTRACT

A bowling game apparatus is disclosed which includes an automatic pin-spotting device. The pin-spotting device is mounted for vertical reciprocal movement generally above the pin end of the alley to position a plurality of pins, conventionally ten, on the end of the alley and to engage and hold the pins while the alley is cleared prior to a player's second ball. The pin clearing operation is effected by a pivotally mounted rear alley portion which pivots downwardly after a first ball, to dump the fallen pins into a pit at the end of the alley. An electrical control system moves the pin-spotting device and the pin clearing mechanism through the same operations each time the electrical system is manually actuated by a player of the game.

17 Claims, 20 Drawing Figures

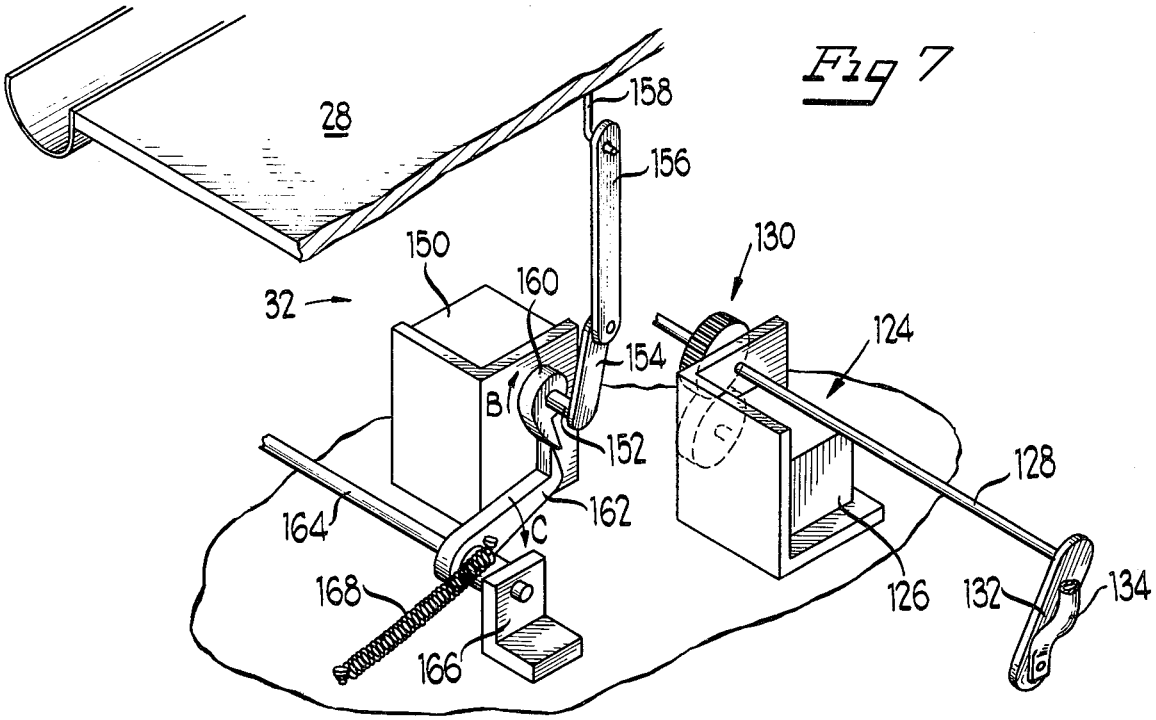
Fig 7
28
158
156
150
160
130
32
124
154
B
152
128
162
164
C
168
126
132
134
166
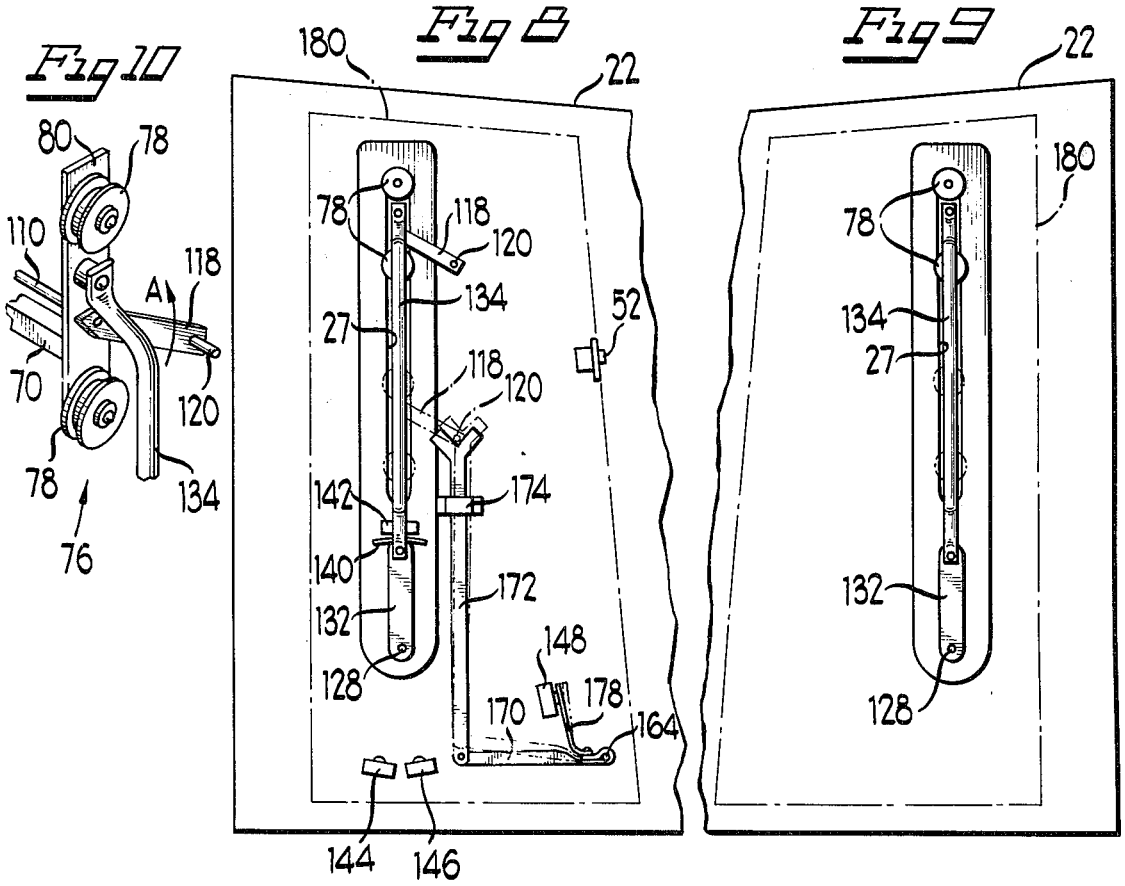
Fig 10
Fig 8
Fig 9
180
22
80
78
110
118
A
120
70
78
134
76
118
120
134
52
27
142
174
140
172
132
148
128
170
178
164
144
146
180
22
78
134
27
132
128

BOWLING ALLEY GAME

BACKGROUND OF THE INVENTION

1. Field of the Invention

This invention relates to bowling alleys and more particularly to a simplified bowling game apparatus requiring a minimum of moving parts.

2. Brief Description of the Prior Art

Many bowling game devices have been provided in which the alley is automatically cleared of deadwood after a player has attempted a roll at the pins. Normally, the pin spotter, after a first ball is thrown, will pick up the remaining standing pins so that the alley can be cleared of the pins which have been successfully knocked down. The pins which were not knocked down on the first roll are replaced on the alley for a second attempt by the player of the game. After the second attempt, all of the pins are cleared from the alley and the new pins are respotted for the next player.

Often, all of the functions which are normally provided by the pin spotter are not necessary during the play of the game. For example, when a novice is first learning to play the game, the ball may end up in the gutter without contacting or knocking over any of the pins. Therefore, it will not be necessary to lift the pins and clear the alley, but this operation will be performed by the automatic mechanism once it detects the presence of a ball in the pit. Similarly, if all of the fallen pins are driven to the pit by the ball, it will not be necessary to clear the alley but the conventional bowling machines automatically go through this process because there is no means for them to distinguish the fact that no fallen pins remain on the alley.

SUMMARY OF THE INVENTION

It is an object of the present invention to provide a novel bowling game apparatus in which certain of the operations of the pin spotter are manually initiated in order to avoid wasted motions by the machine.

Another object of the present invention is to provide a simplified and inexpensive bowling game apparatus suitable for use in the home.

In accordance with the above and other objects, the present invention comprises a bowling game which includes an automatic manually actuated pin-spotting device. The pin-spotting device is mounted for vertical reciprocal movement generally above the pin end of the alley to position a plurality of pins, conventionally ten, on the end of the alley, and to engage and hold the pins while the alley is cleared prior to a player's second ball. The pin-spotting mechanism includes a single, generally horizontally movable slide which is actuated to lock the pins within the pin spotter each time the alley is cleared. The pin clearing operation is effected by a pivotally mounted rear alley portion which pivots downwardly after a first ball to dump the fallen pins into a pit at the end of the alley. A control system moves the pin-spotting device and the pin clearing mechanism through the same operations each time the control system is manually actuated by a player of the game.

Other objects, features and advantages of the invention will be apparent from the following detailed description taken in connection with the accompanying drawings.

BRIEF DESCRIPTION OF THE DRAWINGS

FIG. 7 is a fragmented, rear perspective view of the drive mechanism for the bowling game apparatus of the present invention;

FIG. 8 is a fragmented, right side elevational view of the bowling game apparatus with the cover removed, showing the limit switches;

FIG. 9 is a fragmented, left side elevational view similar to FIG. 8, showing the pin-spotter vertical guide slot;

FIG. 10 is a partially fragmented perspective view, on an enlarged scale, of the pin-spotter guide rollers;

DESCRIPTION OF THE PREFERRED EMBODIMENT

Figure 3:
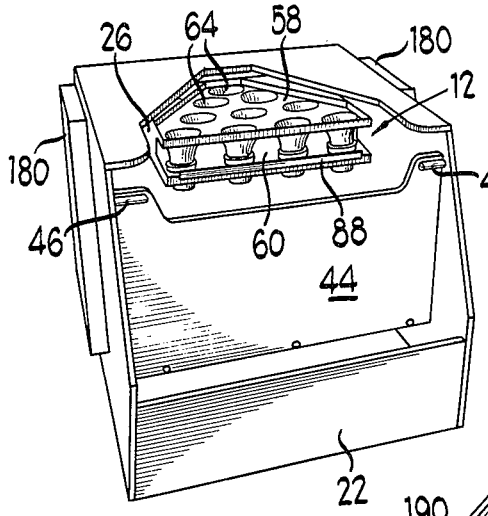
FIG. 3 is a fragmented, rear perspective view of the bowling game apparatus of FIG. 2.
Figure 1:
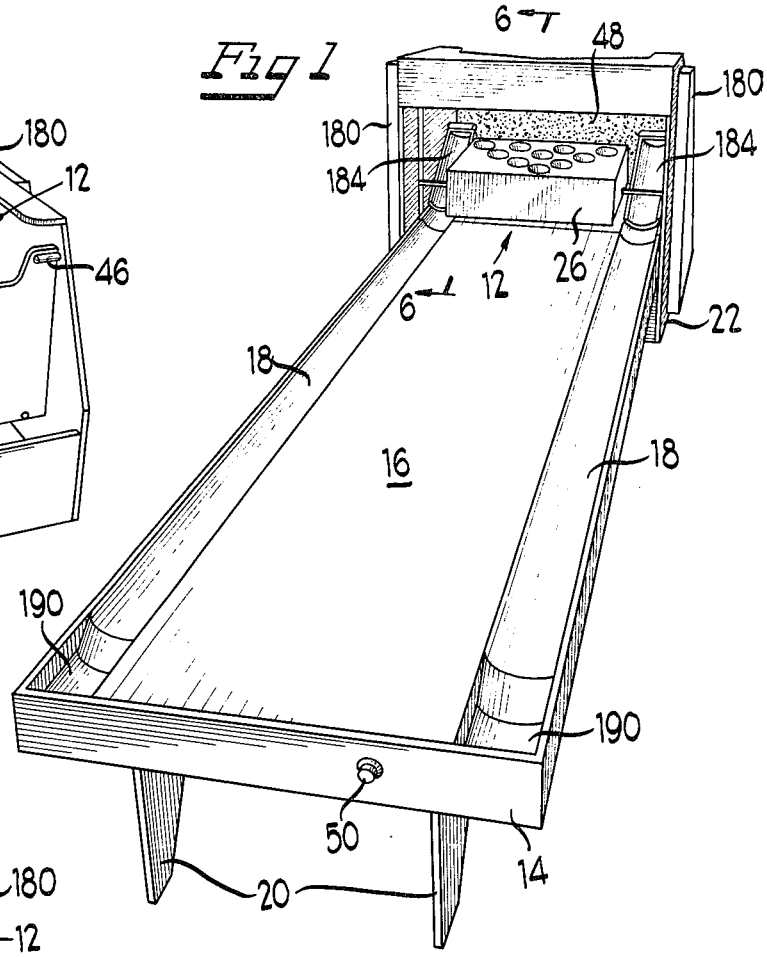
FIG. 1 is a perspective view of a bowling game apparatus made in accordance with the present invention showing the pin-spotting mechanism in its lower position.
Figure 2:
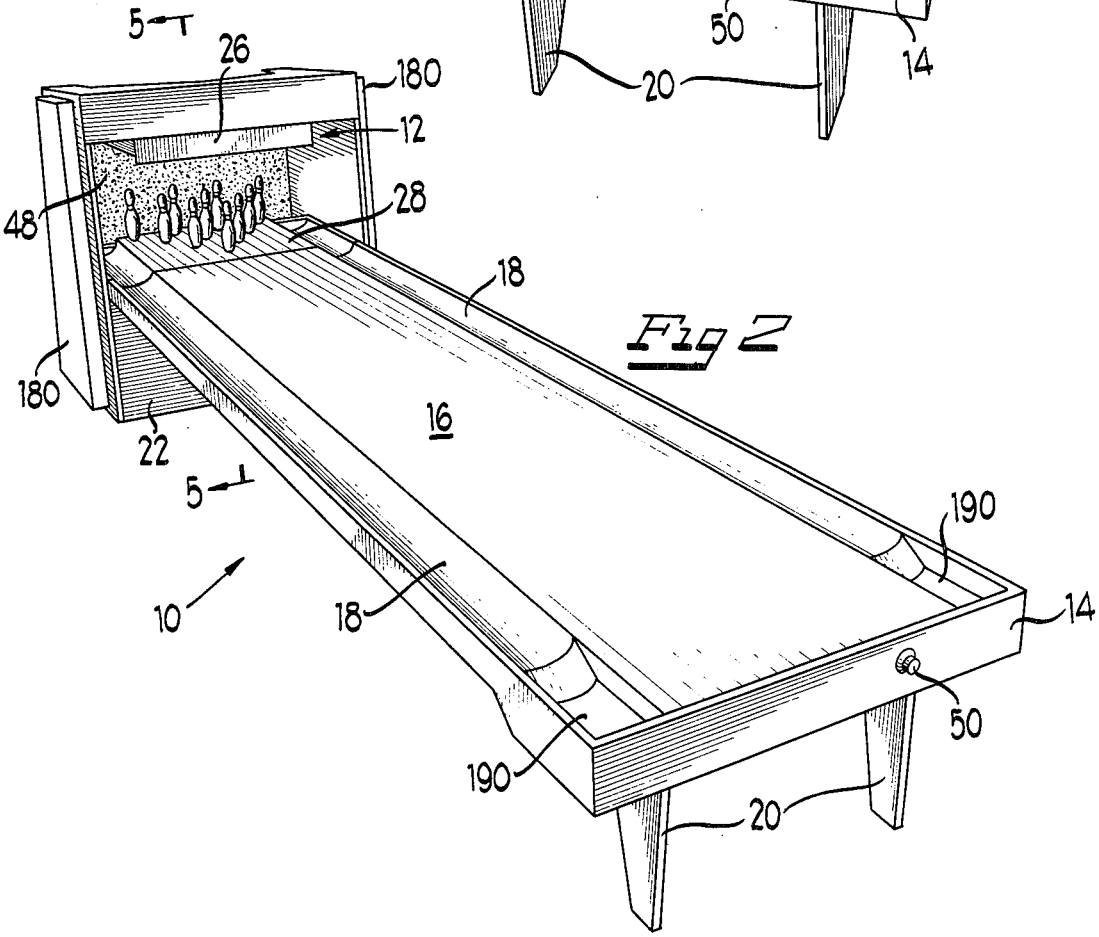
FIG. 2 is a perspective view of the bowling game apparatus of FIG. 1 showing the pin-spotting mechanism in its elevated position with the pins positioned on the alley.

A bowling game apparatus made in accordance with the present invention, generally designated 10, is shown in two perspective views in FIGS. 1 and 2. The bowling alley 10 includes an automatic pin-spotting mechanism, generally designated 12, which is vertically movable between a down or lower position as shown in FIG. 1 and an up or elevated position as shown in FIG. 2. The apparatus includes a generally elongated rectangular frame 14 which supports an alley 16 and a pair of gutters 18, one on either side of the alley 16. The frame is supported at the player end by a pair of legs 20 and at the pin end by a generally cubical housing 22 in a generally horizontal or level position.

Figure 5:
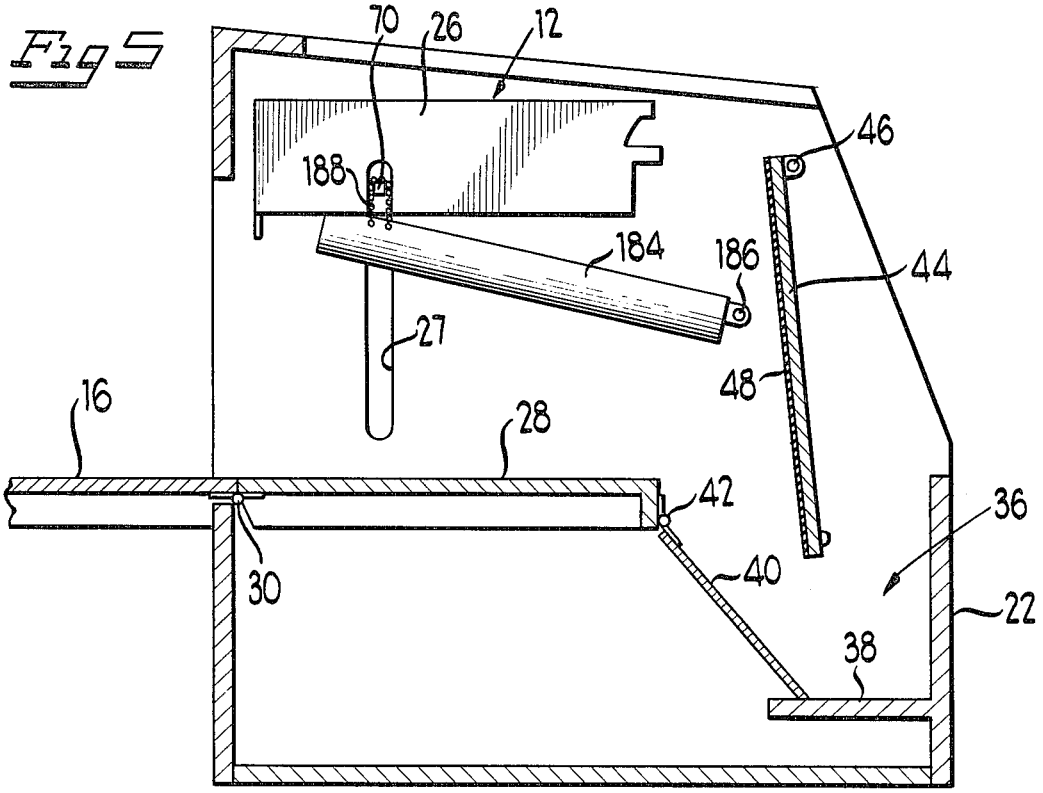
FIG. 5 is a fragmented, vertical section of the bowling game apparatus taken generally along line 5–5 of FIG. 2.
Figure 6:
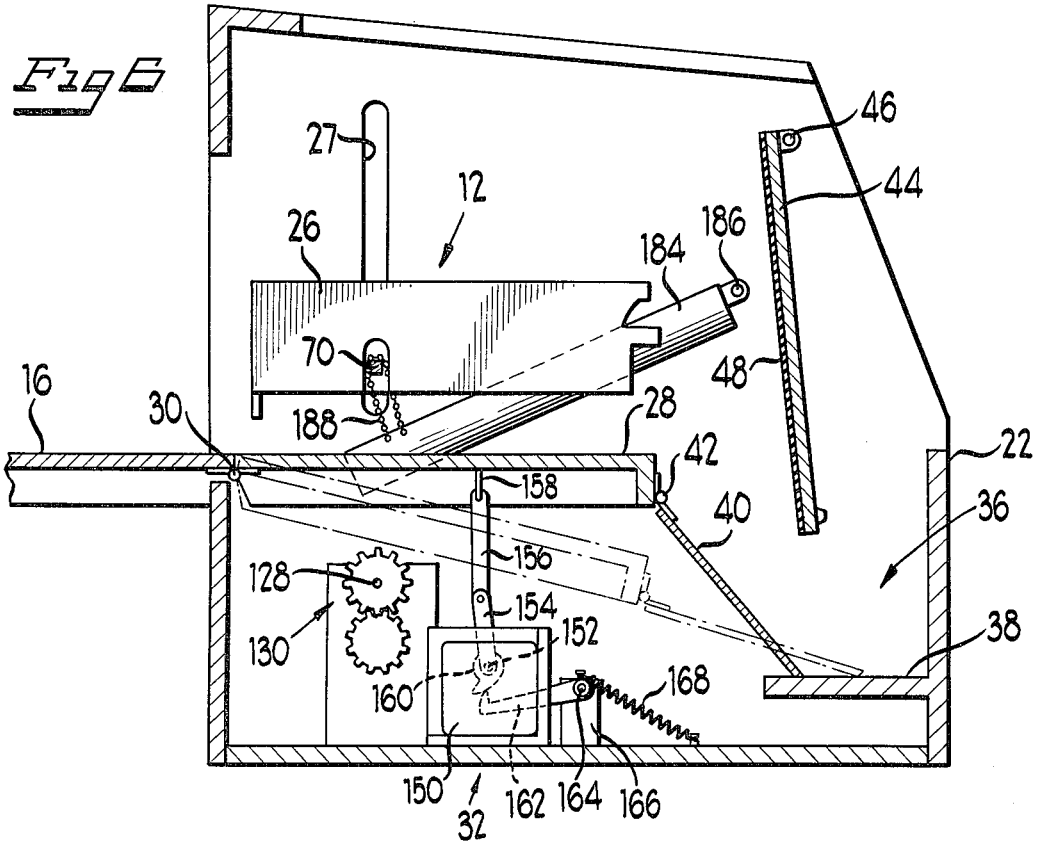
FIG. 6 is a vertical section, similar to FIG. 5, taken generally along line 6—6 of FIG. 1.
Figure 11:
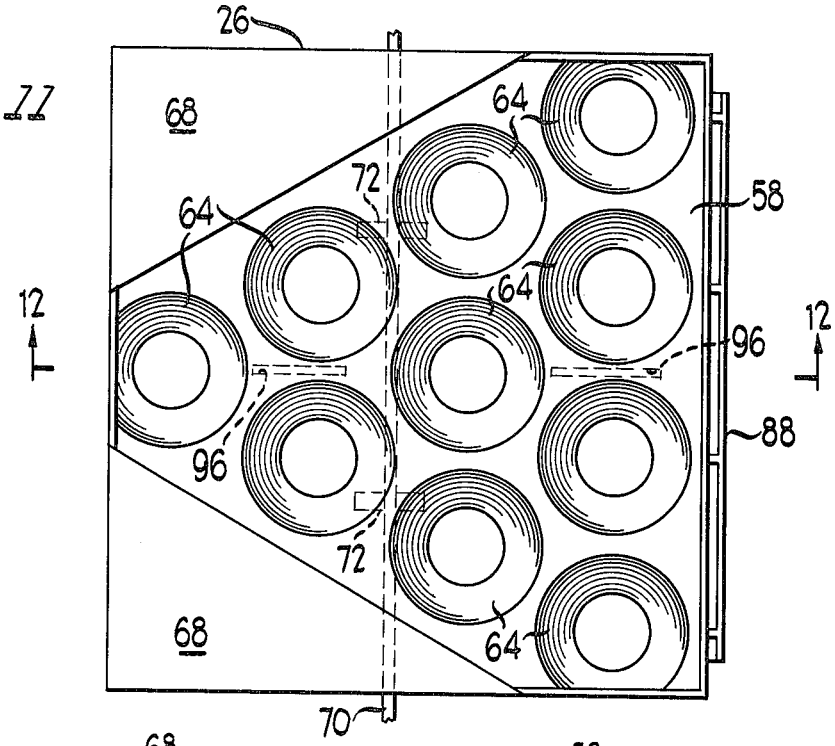
FIG. 11 is a top plan view of the pin-spotting mechanism with the housing removed.

Referring to FIGS. 5 and 6, the housing 22 is seen to enclose the movable portions of the game apparatus. Particularly, the pin-spotting mechanism 12 includes a generally rectangular housing 26 which is mounted for vertical reciprocal movement by a pair of vertical slots or slides 27 in the side walls of the housing. The alley 16 terminates in a tilting alley surface 28 at the pin end of the alley which is pivotally mounted by a hinge 30 to the alley 16. A drive means, generally designated 32 (FIGS. 6 and 7), is drivingly connected to the tiltable surface 28 to pivot the same between a horizontal, generally coplanar position as shown in FIG. 5 and a generally downwardly canted or tilted, clearing position as shown in phantom in FIG. 6. This pivotal movement of the tiltable surface 28 of the alley permits the fallen pins or "deadwood" to be cleared prior to the player's second attempt or second ball. A pit, generally designated 36, is defined at the bottom end of the housing 22 by a generally horizontal rib or flange 38. A pivotally mounted guide plate 40 is secured to the end of the tiltable surface 28 by a hinge 42 to assist and guide the fallen pins into the pit as shown in phantom in FIG. 6. Finally, a rear, shock absorbing wall 44 is connected by a pair of bearings 46 to the side walls of the housing 22 to absorb the shock of the rolling bowling balls as they traverse the alley 16. A resilient or rubber cushion 48 is provided on the front of the wall 44 to facilitate absorption of the shock and reduce noise.

Figure 4A:
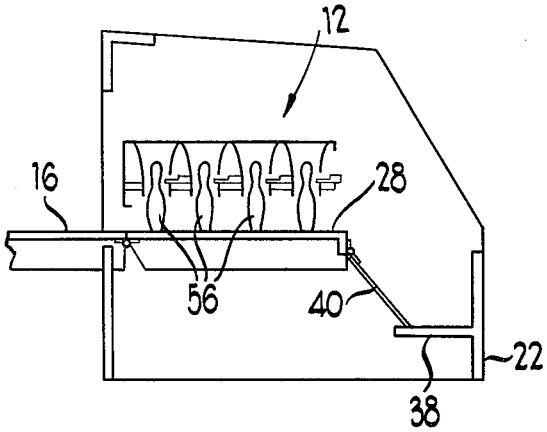
FIGS. 4*a*–4*f* show the sequential operations of the bowling game apparatus, schematically, on a reduced scale.

In order to facilitate the following description of the construction and operation of the bowling game apparatus 10, reference is made to FIGS. 4*a* through 4*f* which show the sequential operation of the apparatus. A pair of manually operable actuators or reset buttons, designated 50, on the front of the housing 14, and 52 on the side of the housing 22 are operated by the players of the game to initiate the pin-spotting and/or clearing operations. Either of the reset buttons 50 or 52 is depressed to move the pin-spotting mechanism 12 to its lowered position as shown in FIG. 4*a* and in FIG. 1. The mechanism 12 will stop at the position as shown in FIG. 4*a* so that one of the players of the game may manually load a plurality of bowling pins 56 onto the tiltable surface 28 of the alley. The pin-spotting mechanism 12 in this operation provides a template which aligns the pins 56 in the normal triangular pattern.

Figure 4B:
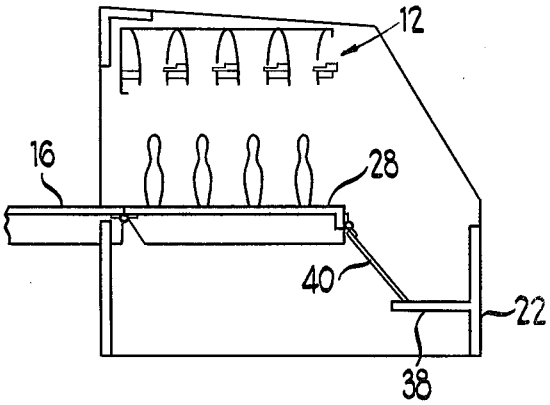

Either reset button then is depressed again which causes the pin-spotting mechanism to be retracted upwardly to its up or elevated position as shown in FIG. 4*b* and FIG. 2. The apparatus is then ready for play, and one of the players rolls a first ball.

Figure 4C:
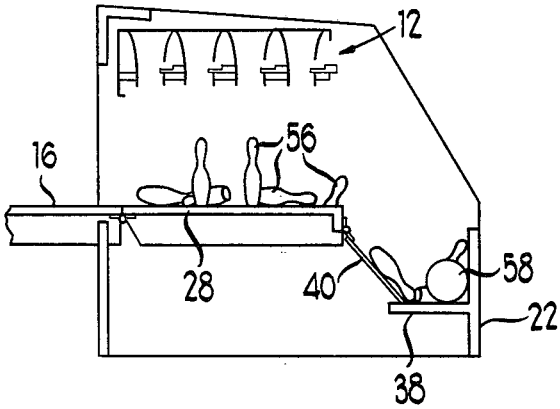

FIG. 4*c* shows that a first ball 58 has been thrown and has fallen into the pit 36. Several of the pins which have been knocked down have also fallen into the pit while several others have remained on the tiltable surface 28 of the alley.

Figure 4D:
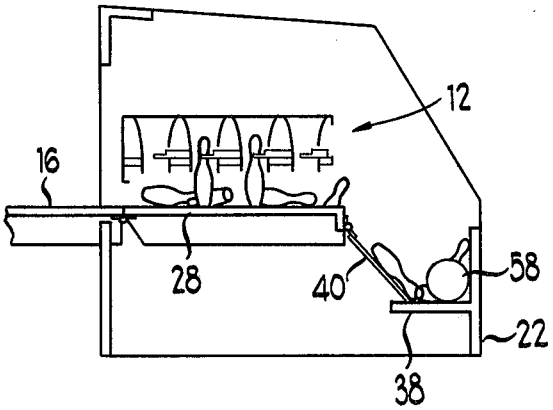
Figure 4E:
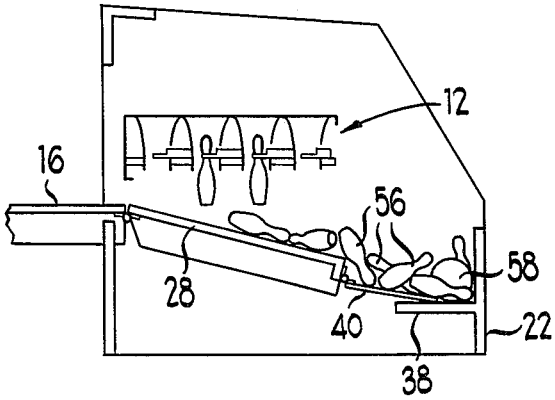
Figure 4F:
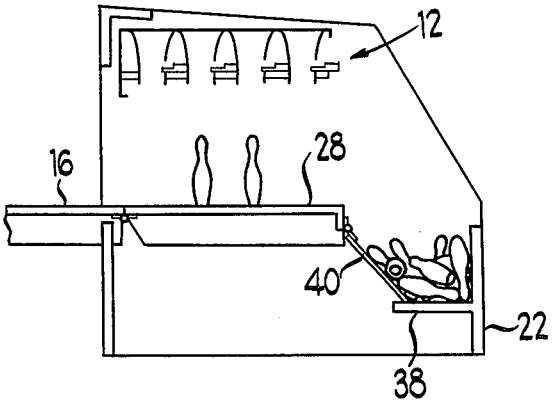

The reset button is again depressed which causes the pin-spotting mechanism 12 to move downwardly as shown in FIG. 4*d* and grasp the remaining standing pins. The pin clearing drive means 32 then pivots the tiltable surface 28 of the alley downwardly to its position as shown in FIG. 4*e* so that all of the fallen pins or deadwood will slide into the pit 36. The drive means 32 remains actuated until the tiltable surface 28 of the alley is returned to its horizontal position. When in its horizontal position, the pin-spotting mechanism releases the pins so that they rest on the pin end of the tiltable surface 28. The player again depresses one of the reset buttons 50 or 52 which retracts the pin-spotting mechanism to its elevated position as shown in FIG. 4*f.* The apparatus is then ready for the player to attempt a second ball.

From this brief description, it can be seen that if a strike is achieved on the first ball, it will not be necessary to activate the mechanism 12 in order to prepare for a second roll, since the pins can be reloaded as shown in FIG. 4*a* for the next frame. Likewise, if a gutter ball is thrown on the first attempt, the mechanism need not be actuated at all, since the player can automatically and immediately attempt his second ball because no pin clearing operation is necessary.

It should be pointed out in conjunction with the above description that the same reset buttons 50 or 52 are depressed to cause the pin-spotting mechanism 12 to be lowered to its down position as shown in FIGS. 4*a,* 4*d,* and 4*e* and again depressed to cause the pin-spotting mechanism 12 to be raised to its elevated position as shown in FIGS. 4*b,* 4*c,* and 4*f.* Each time the pin-spotting mechanism is caused to be lowered, the pin clearing drive means 32 is automatically actuated to cause the tiltable surface 28 to pivot downwardly as shown in FIG. 4*e* whether or not any pins must be cleared from the alley. Although, in some instances, the initiation of the pin clearing mechanism will be superfluous, since no pins have been knocked down, it will be seen and described in detail herein that this particular sequential arrangement permits the use of fewer components and thus a much simpler device. Therefore, the mechanism performs an identical sequential operation every time it is initiated while the necessary complex mechanism of the prior art, which enable the machine to determine whether or not it is a first or second ball, are not used in the present invention.

Figure 12:
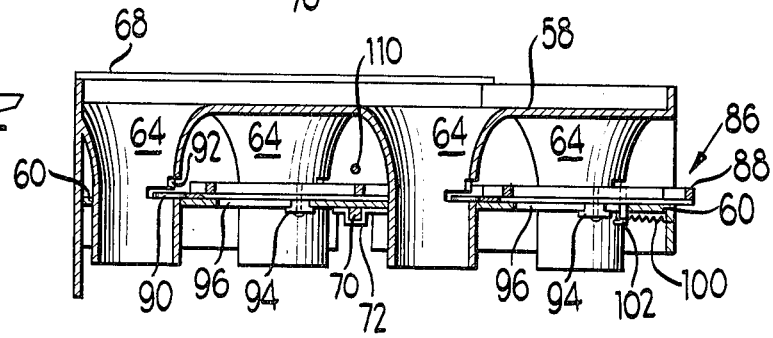
FIG. 12 is a vertical section of the pin-spotting mechanism taken generally along line 12—12 of FIG. 11.
Figure 13:
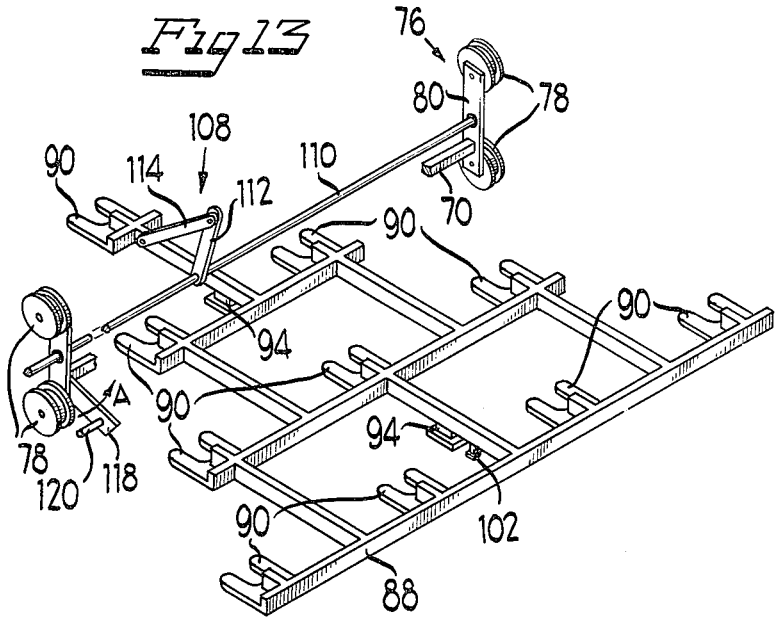
FIG. 13 is a fragmented perspective view of the pin locking mechanism of the present invention.

More particularly, referring to FIGS. 3 and 11 through 14, the pin-spotting mechanism 12 includes the housing 26 which supports a pair of generally parallel plates 58 at the top and 60 at the bottom. The top plate 58 is preferably molded integrally with a plurality, ten, of funnel-shaped pin guides 64. Each of the pin guides 64 extend through the bottom plate 60 and terminate in an aperture which has a diameter approximately equivalent to the largest diameter portion of each of the pins. The housing 26 includes a plurality of vertical walls secured to the edges of the upper and lower plates 58 and 60 and also includes a pair of triangular upper ribs 68 to add rigidity to the housing. The entire pin-spotting mechanism is supported within the slots 27 by a square shaft 70 secured to the lower surface of the bottom plate 60 by a pair of caps 72 which assure proper angular orientation between the shaft 70 and the pin-spotting mechanism 12. The square shaft 70 is secured at its opposite ends to a slot guide means, generally designated 76 (FIGS. 10 and 13). The slot guide means 76 includes a pair of slotted rollers 78 rotatably mounted to a generally vertical flange 80 secured to the shaft 70. The rollers 78 fit within the slots 27 on either side of the housing 22 to provide vertical movement for the pin-spotting mechanism 12 while preventing any rotational movement relative to the slots 27.

Figure 14:
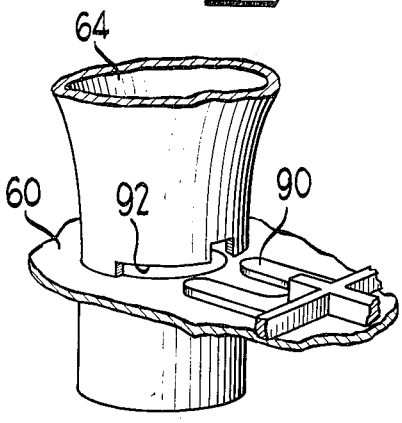
FIG. 14 is a fragmented perspective view of one of the pin-spotting components.

As described in the sequential operation above, the pin-spotting mechanism 12 includes a pin locking means, generally designated 86 (FIGS. 12 and 13), which lock the pins 56, approximately at their necks, for the clearing operation as shown in FIG. 4*e.* More particularly, the pin locking means 86 includes a locking slide 88 which mounts a plurality of yokes 90. The slide 88 is mounted on top of the lower plate 60 for generally longitudinal movement between a clear position, as shown in FIG. 14, and a locking position, as shown in FIG. 4*e.* In the locking position, each of the yokes 90 slides generally forwardly through a crescent-shaped slot 92 (FIG. 14) formed in each of the pin guide means 64 to grip the neck of a pin to prevent the pin from falling out of the guide means 64. The slide 88 is mounted by a pair of T-studs 94 within a pair of aligned slots 96 in the lower plate 60. The slide 88 is biased by a spring 100 (FIG. 12) connected between stud 102 and the housing 26 to its clear position as shown in FIGS. 12 and 14.

A pin locking drive means, generally designated 108, includes a rotatable shaft 110 mounted between the vertical flanges 80 for rotation in the direction of arrow A from the clear position as shown in FIGS. 10 and 13 to a locking position as shown in FIG. 4e. The shaft 110 includes a central crank arm 112 which is pivotally connected to a second shaft 114 pinned to the slide 88. As the shaft 110 rotates in the direction of arrow A, the slide will be urged forwardly to lock the pins. An exterior crank arm 118 on the end of the shaft 110, as shown in FIG. 13, includes an actuator pin 120 which facilitates rotation of the shaft 110, as will be described in greater detail hereinafter.

The pin-spotting mechanism 12 is moved between its elevated position and its lowered position by a drive means, generally designated 124 (FIG. 7). The drive means includes a motor secured to the bottom of the housing 22 which drives the longitudinal shaft 128 through an appropriate series of gears, generally designated 130. The shaft 128 extends in both directions beyond the walls of the housing 22 for mounting a crank arm 132, one of which is shown in FIG. 7. The crank arm 132 is connected by a connecting rod 134 to the guide means 76. The connecting rod 134 is pivotally connected at its lower end to the crank arm 132 and to the guide means 76. As the motor 126 rotates, the connecting shaft 134 will move the pin-spotting mechanism 12 between its extreme positions.

A switch actuating shoe 140 is mounted on the end of the crank arm 132 to close a plurality of switches during its rotation. The switches actuated by the shoe 140 include a top dead-center switch 142, a bottom before dead-center switch 144 and a bottom dead-center switch 146. The operation of these switches in addition to a fourth switch 148 which operates the pin clearing drive means 32 will be discussed in detail with respect to the electrical diagram of FIG. 15.

Referring to FIGS. 7 and 8, the pin clearing drive means 32 includes a motor 150 secured to the base of the housing 22. An output shaft 152 of the motor is connected by a crank arm 154 to a connecting rod 156. The connecting rod 156 is further connected to a depending L-shaped shaft 158 on the bottom of the tiltable surface 28 of the alley. When the motor 150 is energized, it will rotate 360° in the direction of arrow B as shown in FIG. 7 to lower and again raise the tiltable surface 28 in one smooth operation. A cam 160 is secured to the motor shaft 152 in constant engagement with a cam follower 162. The cam follower is mounted on a generally horizontal shaft 164 pivoted within a journal 166 on the housing and extends through an appropriate aperture on the side of the housing as shown in FIG. 8. The cam follower 162 is biased by a spring 168 into constant engagement with the cam 160. A generally horizontal crank arm 170 is secured to the end of the shaft 164 and pivotally connected to a vertically reciprocating yoke 172. The yoke 172 extends upwardly through a guide 174 in general alignment with the pin 120 on the crank arm 118. As shown in FIGS. 7 and 8, when the tiltable surface 28 of the alley is in its horizontal position, the highest point of the cam 160 is in engagement with the cam follower 162 which maintains the yoke 172 in its downwardmost position as shown in solid lines in FIG. 8. However, as soon as the motor 150 is energized, the cam follower immediately drops over the high point of the cam 160 which moves the yoke 172 to its uppermost position as shown in phantom in FIG. 8. If the pin-spotting mechanism 12 is in its lowered position as shown in solid in FIG. 8, the yoke 172 will engage the pin 120 thus rotating the crank 118 in the direction of arrow A as shown in FIG. 13 causing the slide 88 to move forward to lock the pins as previously discussed. As the motor 150 continues to rotate, the cam 160 will slowly pivot the cam follower downwardly in the direction of arrow C in FIG. 7 to move the yoke back down to its lowermost position to release the pin locking mechanism 86. The motor 150 simultaneously operates the switch 148 through an offset tab 178 mounted on the horizontal crank 170. The switch 148 is a normally open switch and is in its open position when the yoke is down as shown by the solid lines in FIG. 8. A pair of side housing covers 180 conceal the mechanism on each side of the housing.

Referring to FIGS. 5 and 6, a pair of pivotally mounted ball return gutters 184 are shown. As seen in FIG. 1, the pivotal ball return gutters 184 each are mounted on either side of the pin-spotting mechanism 12 by a generally horizontal shaft 186 secured to the respective sides of the housing 22. The free end of each of the gutters 184 is loosely connected, as by a chain 188, to the square shaft 70 which supports the pin-spotting mechanism 12. As the pin-spotting mechanism moves between its raised and lowered positions, the gutters 184 likewise pivot about the shaft 186 between an up position as shown in FIG. 5 and a down position as shown in FIG. 6. In the down position, the first ball thrown can be placed in either of the gutters 184 for return to the user. A detent or cavity 190 is provided at the forward end of each gutter 18 to capture the returned ball.

Figure 15:
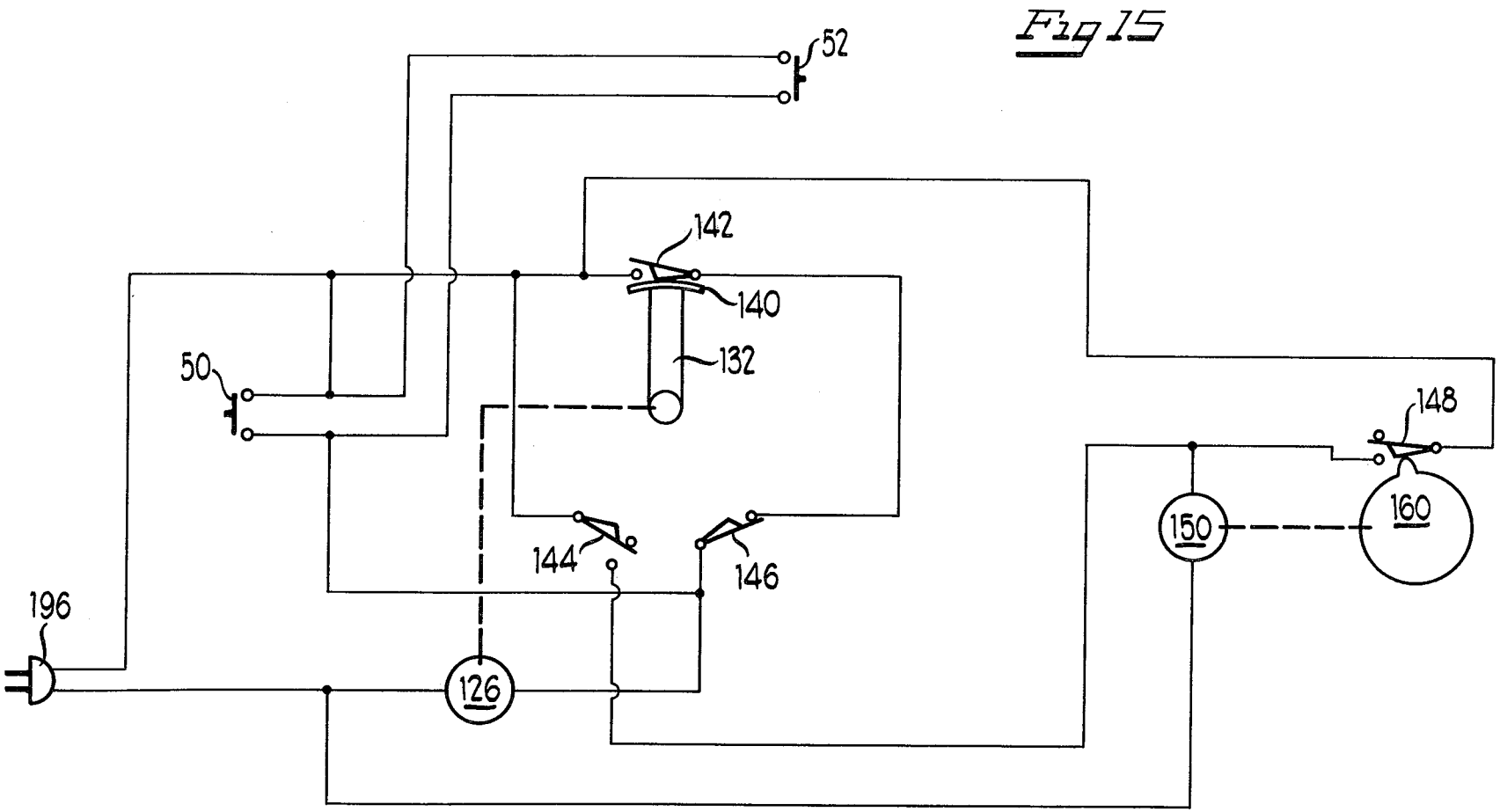
FIG. 15 is an electrical schematic view of the control means of the present invention.

The operation of the bowling game apparatus is controlled by the electrical diagram of FIG. 15 and will be discussed with reference to FIGS. 7, 8 and 6. The electrical diagram shows the crank arm 132 and shoe 140 which operate the switches 142, 144 and 146. The crank arm 132 is schematically shown as being driven by the motor 126. On the righthand side of the diagram, for simplicity, the operation of the switch 148 is shown as being operated by the cam 160 as driven by the motor 150. In actuality, however, the switch 148 is driven by the cam 160 through a series of linkages as previously described. There are provided two reset switches 50 on the front of the frame and 52 on the side of the housing 22 for initiating the operation of the electrical system. Typically, the system can be powered by a 120 v. AC power supply through a plug 196. The power is connected to the motor 126 when both of the switches 142 and 146 are closed or when either of the reset buttons 50 and 52 are momentarily closed. The power is transmitted to the pin clearing drive means motor 150 when either the switch 144 is closed or when the switch 148 is closed. At the beginning of play, when the pin-spotting mechanism 12 is in its upper position as shown in FIG. 8, the switch 142 is held open by the shoe 140 on the crank arm 132. To initiate operation, either of the reset buttons 50 or 52 is closed momentarily which starts the motor 126. Once the motor has begun, the shoe 140 will permit the switch 142 to close and thus the motor 126 will continue to rotate even after the reset button is released. The motor 126 will continue to rotate through an angle of approximately 180° at which time the shoe 140 closes the switch 144. The motor will continue to rotate slightly until the bottom dead-center switch 146 is opened by the shoe 140 which terminates the power to the motor 126 and stops the movement of the pin-spotting mechanism 12 in its lowermost position. As described, just before motor 126 stops, the switch 144 is closed to energize the motor 150. The motor 150, in turn, rotates the cam 160 which closes switch 148 and continues power to the motor 150 after the switch 144 has opened. When the pin-spotting mechanism 12 descends, the yoke 170, which is normally in its lower position, does not engage the pin 120 and lock the pins until the cam 160 rotates slightly to release the yoke. Thus, the yoke is pivoted upwardly by the spring force 168 to actuate the slide 88 and lock the pins within the housing 26. Continued operation of the motor 150 then causes the pivoted portion of the tiltable surface 28 to pivot downwardly through its pin clearing operation and back up to the level position. At its level position, the cam 160 opens the switch 148 after the yoke 172 has been withdrawn to its lowermost position to release the locking slide 88. Thus, any pins remaining on the alley have been locked into position while the alley dumps any of the deadwood and returns to its level position, whereafter the pins are released to be supported by the alley. At this point in the sequence, the entire electrical system is de-activated since the switch 144 and 146 are in their open position. The player must then depress the reset button 50 or 52 again which energizes the motor 126 to move the pin-spotting mechanism to its elevated position until the switch 142 is again open. When the switch 142 opens, the pin-spotting mechanism 12 stops at its elevated position and the player is free to attempt to knock down the pins. As described above, this sequence of operations will occur both at the beginning of each frame and at an intermediate point to clear the deadwood from the alley. For example, at the beginning of a frame, in order to reset all of the pins, the reset button is pressed one time which lowers the pin-spotting mechanism and dumps the tiltable surface 28 even though there may be no pins on the alley. When the tiltable alley portion 28 reaches its level position, the locking mechanism 86 is disengaged because the yoke 172 has been driven downwardly to its lower position by the cam 160. The player is then free to manually load the pins through the guide means 64 onto the alley. A second depressing of the reset button 50 or 52 causes the pin-spotting mechanism 12 to be raised for the play of the game. After a ball is thrown, if several pins have been knocked down and remain on the alley, the sequence is operated again to clear the alley. During this operation, the pin-spotting mechanism 12 is lowered by depressing either of the reset buttons 50 or 52. When the pin-spotting mechanism 12 reaches its lowermost position, the pin clearing motor 150 has been energized. As the cam 160 begins to move, the pin locking means 86 is actuated to grasp the pins as shown in FIGS. 4*d* and 4*e* while the tiltable alley portion 28 pivots downwardly to dump the fallen pins into the pit 36. The motor 150 continues to be energized until the tiltable alley portion 28 reaches its horizontal position where the switch 148 opens to de-energize the motor 150. At this time, the cam 160 through the cam follower 162 has released the pin locking mechanism 86 so that a subsequent depressing of either of the reset buttons will move the pin-spotting mechanism to its elevated position.

Thus, with this sequence of operations, it will often be possible to save time and machine functions, for example, in particular situations. For example, if on the first ball thrown, all of the fallen pins are driven into the pit by the momentum of the ball, it is not necessary to clear the tiltable surface 28 and thus the player can immediately proceed with his second ball. Alternatively, if a gutter ball is thrown on a player's first attempt, no pin clearing procedure is necessary since the player can immediately throw his second ball. In normal or conventional bowling alleys, even though a gutter ball is thrown, the machine will automatically pick up all ten of the pins, clear the alley, and reset all of the pins onto the alley. Another advantage of the present bowling game apparatus is that the pin-spotting mechanism 12 does not have to lift the pins upwardly during the pin clearing operation since it is the alley itself which dumps the pins into the pit 36. This is clearly advantageous since the mechanism and wiring required to raise and lower the pin-spotting mechanism 12 during the clearing operation is no longer necessary. Also, the game apparatus 10 will save time when a strike has been thrown since the player can depress the reset button 50 and while he is walking to the back of the device to reset the pins, the mechanism will be moving through its necessary operations so that, by the time the player reaches the back of the alley to manually reset the pins, the apparatus will be ready to accept a new set of pins.

While this invention is susceptible of embodiment in many different forms, the foregoing detailed description has been given for clearness of understanding as an exemplification of the principles of the invention only and no unnecessary limitations should be understood therefrom, as some modifications may be obvious to those skilled in the art.

We claim:

1. A bowling alley game including an automatic pin clearing apparatus, comprising:

a bowling alley having a pit at one end thereof;

a pin supporting, tiltable alley portion at the end of said alley adjacent said pit, said tiltable alley portion being pivotally connected to the end of said alley for movement between a generally horizontal position, coplanar with the alley, and a pin clearing position whereat the tiltable alley portion is pivoted downwardly with respect to said alley causing pins thereon to be transferred to the pit;

drive means for moving the tiltable alley portion between its respective positions; and a manual actuator connected to said drive means for initiating operation thereof.

2. The bowling game apparatus of claim 1 wherein said drive means includes a crank to move the tiltable alley from its horizontal position to its pin clearing position and back to its horizontal position, and limit switch means operatively associated with said drive means and said manual actuator to de-activate the same when said tiltable alley portion reaches said horizontal position.

3. The bowling game apparatus of claim 2 wherein said drive means includes cam means operatively associated with said limit switch means to de-activate said drive means when said tiltable alley portion reaches a horizontal position.

4. The bowling game apparatus of claim 1 including a pin spotter mounted above said pivoted alley portion for generally vertical, reciprocal movement between a first, elevated position above the tiltable alley portion and a second, lowered position generally adjacent the tiltable alley portion.

5. The bowling game apparatus of claim 4 wherein said pin spotter includes pin locking means operatively associated with said drive means for locking the standing pins therein while said tiltable alley portion is pivoted to transfer the fallen pins into the pit.

6. The bowling game apparatus of claim 5 wherein said pin spotter includes a housing having a bottom plate with openings formed therein which are aligned with predetermined pin positions on said tiltable alley portion through which the pins may pass, and said pin locking means includes a horizontally disposed locking member mounted for reciprocal movement, said locking member being provided with a plurality of slots aligned with the openings in said bottom plate and means for reciprocating said locking member for releasably supporting a set of pins about their necks between said slots and said bottom plate whereby the pins which have not fallen may be supported by said pin spotter during pivoting of the tiltable alley portion and repositioned on the surface after the alley portion returns to a horizontal position.

7. The bowling alley game of claim 6 wherein said means for reciprocating said locking member includes a generally transverse rotatable shaft, a crank arm secured to the shaft intermediate its ends, a connecting rod pivoted to the end of said crank and said locking member, and a second crank arm on one end of said transverse shaft whereby the pin locking member can be moved into engagement with said pins by rotation of said second crank arm.

8. The bowling alley game of claim 7 including connecting means between said drive means and said second crank arm for actuation of said pin locking member in a timed relationship with the pivotal movement of said tiltable alley portion.

9. The bowling alley game of claim 8 including a second drive means operatively associated with said pin spotter for moving the pin spotter between its first and second positions upon manual operation of said actuator.

10. The bowling alley game of claim 9 including second switch means associated with said second drive means for initiating operation of said drive means in response to movement of the pin spotter between its first position and its second position.

11. A method for clearing fallen pins from a bowling game apparatus including an alley having a pivotally connected tiltable alley portion at the pin end thereof and a pin holding means for receiving a plurality of bowling pins and releasably supporting said pins generally about their necks, comprising the steps of:

grasping the standing pins generally about their neck;

pivoting said tiltable alley portion downwardly about said pivotal connection to cause the pins thereon to be transferred off the end of the tiltable alley portion;

pivoting said tiltable alley portion back to its horizontal position; and releasing the standing pins for support by the alley.

12. The method of claim 11 including the steps of lowering the pin holding means over the standing bowling pins prior to actuation thereof and raising the pin holding means to a position above the standing pins after release by the pin holding means.

13. A bowling alley game comprising, in combination:

a pin clearing apparatus including a bowling alley having a pin supporting, tiltable alley portion connected to the end thereof for movement between a generally horizontal position, coplanar with the alley, and a pin clearing position whereat the tiltable alley portion is pivoted downwardly with respect to the alley permitting any fallen pins to be removed by gravitational forces, selectively operable first drive means for moving the tiltable alley portion between its respective positions;

a pin spotter including a housing mounted for generally vertical, reciprocal movement between a first elevated position above the tiltable alley portion and a second lowered position generally adjacent the tiltable alley portion, means for positioning a plurality of pins therein, and pin holding means including locking means for engaging the necks of a plurality of pins for support therein;

selectively operable second drive means for moving the pin spotter between its respective positions upon manual actuation thereof; and limit switch means associated with said second drive means for initiating operation of said first drive means after the pin spotter reaches a predetermined position.

14. The bowling alley game of claim 13 wherein said pin holding means is operatively associated with said first drive means for locking the standing pins therein prior to movement of the tiltable alley portion to its pin clearing position and for releasing the pins after said tiltable alley portion reaches its horizontal position.

15. The bowling alley game of claim 14 wherein said pin spotter includes a housing having a bottom plate with openings formed therein which are aligned with predetermined pin positions on said tiltable alley portion through which the pins may pass, and said pin locking means includes a horizontally disposed locking member mounted for reciprocal movement, said locking member being provided with a plurality of slots aligned with the openings in said bottom plate and means for reciprocating said locking member for releasably supporting a set of pins about their necks between said slots and said bottom plate whereby the pins which have not fallen may be supported by said pin spotter during pivoting of the tiltable alley portion and repositioned on the surface after the alley portion returns to a horizontal position.

16. The bowling alley game of claim 15 wherein said means for reciprocating said locking member includes a generally transverse rotatable shaft, a crank arm secured to the shaft intermediate its ends, a connecting rod pivoted to the end of said crank and said locking member, and a second crank arm on one end of said transverse shaft whereby the pin locking member can be moved into engagement with said pins by rotation of said second crank arm.

17. The bowling alley game of claim 16 including connecting means between said first drive means and said second crank arm for actuation of said pin locking member in a timed relationship with the pivotal movement of the tiltable alley portion.

* * * * *